US010781727B2

(12) United States Patent
Belicke et al.

(10) Patent No.: US 10,781,727 B2
(45) Date of Patent: Sep. 22, 2020

(54) CAM PHASER AND CAM SHAFT ARRANGEMENT WITH CAM PHASER

(71) Applicant: ECO Holding 1 GmbH, Marktheidenfeld (DE)

(72) Inventors: Sebastian Belicke, Wernau (DE); Andreas Berwinkl, Aichtal-Groetzingen (DE); Norbert Loesch, Kirchheim (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 25 days.

(21) Appl. No.: 16/261,458

(22) Filed: Jan. 29, 2019

(65) Prior Publication Data

US 2019/0234249 A1 Aug. 1, 2019

(30) Foreign Application Priority Data

Jan. 30, 2018 (DE) ..... 10 2018 101 971
Oct. 23, 2018 (DE) ..... 10 2018 126 302

(51) Int. Cl.

| | |
|---|---|
| ***F01L 1/34*** | (2006.01) |
| ***F01L 1/344*** | (2006.01) |
| ***F01L 1/02*** | (2006.01) |
| ***F01L 1/047*** | (2006.01) |

(52) U.S. Cl.

CPC ..... *F01L 1/3442* (2013.01); *F01L 1/022* (2013.01); *F01L 1/047* (2013.01); *F01L 2001/34453* (2013.01); *F01L 2001/34469* (2013.01); *F01L 2001/34483* (2013.01); *F01L 2301/00* (2020.05)

(58) Field of Classification Search

CPC ..... F01L 1/047; F01L 1/022; F01L 1/3442; F01L 2101/00; F01L 2101/34469; F01L 2103/00

See application file for complete search history.

(56) References Cited

U.S. PATENT DOCUMENTS 6,845,740 B2 * 1/2005 Kohrs ..... F01L 1/34 123/90.17

FOREIGN PATENT DOCUMENTS

| | | | |
|---|---|---|---|
| DE | 19710932 | A1 | 10/1997 |
| DE | 10161698 | A1 | 6/2003 |
| DE | 10161701 | A1 | 6/2003 |
| DE | 102009050779 | A1 | 4/2011 |
| DE | 102011014460 | A1 | 9/2012 |
| DE | 102011077020 | A1 | 12/2012 |
| DE | 102015220169 | A1 | 4/2017 |
| LI | 102012219949 | A1 | 4/2014 |
| WO | WO2016131730 | A1 | 8/2016 |

* cited by examiner

*Primary Examiner* — Zelalem Eshete
(74) *Attorney, Agent, or Firm* — Von Rohrscheidt Patents

(57) ABSTRACT

A cam phaser for a camshaft, the cam phaser including a stator that is operatively connected with a crankshaft through a drive wheel; a rotor that is connectable torque proof with a camshaft and rotatable relative to the stator, wherein the drive wheel is connected torque proof or integrally configured in one piece with a stator base element or with a stator cover that is connected to and sealed relative to the stator base element, wherein a vane of the rotor is arrangeable between two bars of the stator and an intermediary space that is configured between the two bars is divided by the vane into a first pressure cavity and a second pressure cavity.

13 Claims, 4 Drawing Sheets

CAM PHASER AND CAM SHAFT ARRANGEMENT WITH CAM PHASER

RELATED APPLICATIONS

This application claims priority from and incorporates by reference German patent applications DE 10 2018 101 971.8, filed on Jan. 30, 2018, and DE 10 2018 126 302.3, filed on Oct. 23, 2018.

FIELD OF THE INVENTION

The invention relates to a cam phaser for a camshaft according to the preamble of patent claim 1. The invention also relates to a camshaft arrangement with a camshaft and a cam phaser.

BACKGROUND OF THE INVENTION

Cam shaft arrangements and cam phasers for camshafts of internal combustion engines are well known in the art. The cam phasers are used in modern internal combustion engines to optimize fuel burn and power and are used for adjusting opening and closing times of gas control valves in order to be able to variably adjust a phase relationship between the crankshaft and the camshaft in a defined angle range between a maximum early position and a maximum late position. For this purpose, the cam phaser is integrated in a drivetrain through which torques are transferred from the crankshaft to the camshaft. Thus the cam phaser has a stator that is driven by the crankshaft and a rotor that is connected torque proof with the camshaft. Between the rotor and the stator operating chambers are provided that are loadable with a hydraulic fluid wherein the operating chambers are divided into counteracting pressure cavities by blades that are associated with the rotor. During operations of the internal combustion engine, both pressure cavities are permanently filled with the hydraulic fluid so that the rotor and the stator are connected with each other in a relatively stiff manner. Timing of the gas control valves is adjusted in that a pressure in one of the pressure cavities is increased while a pressure in a respective other pressure cavity is reduced. For this purpose, the hydraulic fluid has to be fed to the first pressure cavity and drained from the other pressure cavity towards a tank which adjusts an angular orientation between the camshaft and the crankshaft. The cam phaser or the camshaft arrangement are subjected to high alternating torques and transversal forces at the cam drive.

It is known e.g. from DE 10 2009 050 779 A1 to provide a friction disc in order to increase friction of a friction locked connection between the camshaft and the cam phaser.

BRIEF SUMMARY OF THE INVENTION

Thus, it is an object of the invention to improve a cam phaser for a camshaft, in particular for an application under very high alternating torques and transversal forces.

It is another object of the invention to improve a camshaft arrangement with a camshaft and a cam phaser, in particular for applications under very high alternating torques and transversal forces.

The object is achieved according to the invention by a cam phaser for a camshaft, the cam phaser including a stator that is operatively connected with a crankshaft through a drive wheel; a rotor that is connectable torque proof with a camshaft and rotatable relative to the stator, wherein the drive wheel is connected torque proof or integrally configured in one piece with a stator base element or with a stator cover that is connected to and sealed relative to the stator base element, wherein a vane of the rotor is arrangeable between two bars of the stator and an intermediary space that is configured between the two bars is divided by the vane into a first pressure cavity and a second pressure cavity, wherein the rotor or a component that cooperates with the rotor includes a first contact surface configured to provide a friction locking connection with a second contact surface that is configured at the camshaft or at a camshaft component, wherein the stator base element includes a third contact surface configured to provide a friction locking connection with a fourth contact surface configured at the stator cover and wherein devices are provided that increase a friction of the friction locking connection by a micro form locking between the rotor and the camshaft or between the stator base element and the stator cover, wherein hard particles are provided that increase the friction and that are connected or connectable with at least one contact surface from the group consisting of the first contact surface, the second contact surface, the third contact surface and the fourth contact surface without additional components or coatings of the at least one contact surfaces.

The object is also achieved by and a camshaft arrangement with the cam phaser recited supra.

Advantageous embodiments and useful and non-trivial improvements of the invention can be derived from the respective dependent claims.

The cam phaser according to the invention includes a stator which is operatively connected through a drive wheel with a crankshaft and a rotor that is connectable torque-proof with a camshaft and rotatable relative to the stator. The drive wheel is connected torque-proof or integrally configured in one piece with a stator base element or a stator cover that is connected with and sealed relative to the stator base element. A respective vane of the rotor is positionable between two bars of the stator and an intermediary space configured between the two bars is divided by the vane into a first pressure cavity and a second pressure cavity. The rotor or a component that cooperates with the rotor includes a first contact surface for a friction locking connection with a second contact surface that is configured at the camshaft or at a camshaft component. Furthermore, the stator base element includes a third contact surface for a friction locking connection with a fourth contact surface that is configured at the stator cover. Devices are provided for increasing a friction of the friction-locking connection by a micro form-locking between the rotor and the camshaft, and/or between the stator base element and the stator cover.

According to the invention hard particles are provided in order to increase a friction value wherein the hard particles are connectable or connected with at least one of the contact surfaces without additional components or coatings on the contact surfaces. The hard particles advantageously increase static friction at the contact surfaces between the two connected friction partners. Thus, higher torques or transversal forces can be transferred under the same preload of the friction partners, thus between the rotor and the camshaft and/or between the stator base element and the stator cover. By the same token, the preload of the friction partners can be reduced for identical transferrable moments. An additional component for friction increase and thus associated assembly and additional processing of the components for the additional component can be omitted. By the same token, an additional coating of the contact surface or of the contact surfaces and the associated complexity can be omitted. By omitting additional components or coatings, the existing tolerance concatenation of the cooperating components can be advantageously reduced.

According to advantageous embodiment of the invention, the hard particles include a jacket, wherein the hard particles are connectable or connected with the at least one contact surface loss-proof by melting the jacket. The melting process facilitates loss-proof adhesion of the hard particles. The hard particles can thus be adapted with respect to their sizes to the prevailing torques and transversal forces.

Advantageously the hard particles are partially or entirely applied to the contact surfaces which facilitates adapting the friction increase even further.

According to an advantageous embodiment, the hard particles are configured as industrial diamonds with a nickel encasement and applied by an atmospheric plasma coating method so that they adhere.

The contact surfaces are configured as faces in an advantageous embodiment wherein the faces are connectable with each other in a friction-locking manner, e.g., by a central bolt of a central valve. The hard particles are applicable to the faces in a simple manner.

The hard particles can also be applied to the first contact surface of the rotor and/or to the second contact surface of the camshaft and/or to the third contact surface of the stator base element, and/or to the fourth contact surface of the stator cover so that they adhere. Embodiments with all conceivable combinations can be used for different applications.

Alternatively, the rotor includes an adapter at which the first contact surface is configured. The adapter can be made from a different material than the rotor or can be heat treated.

According to an advantageous embodiment of the invention, the hard particles are applied to adhere at least to the third contact surface of the stator base element, wherein the third contact surface is configured from plural contact portions that are provided in the portion of receiving boreholes that are configured in the bars. Thus, the friction increasing devices are arranged in highly loaded portions of the stator base element.

Advantageously, the contact portions are circular and respectively configured concentric with the respective receiving borehole which simplifies a controlled application in the highly loaded portions.

By the same token, the contact portions can be configured about the respective receiving borehole as a function of load. Put differently, a non-symmetrical configuration of the contact portions is conceivable.

In order not to influence the bolting function through the hard particles, the contact portions are advantageously provided respectively at a particular distance from the receiving borehole. This recess can be advantageously produced by a masking/covering of the threaded borehole.

The camshaft arrangement according to the invention includes a camshaft and a cam phaser described supra.

Advantageously, the camshaft and the rotor are connected in a friction-locking manner by a central bolt.

BRIEF DESCRIPTION OF THE DRAWINGS

Further advantages, features and details of the invention can be derived from the subsequent description of embodiments and from the drawing figure. The features and combinations recited in the preceding description and the features and feature combinations subsequently recited in the figure description and/or in the figures by themselves are not only usable in the respectively recited combination but also in other combinations or by themselves without departing from the spirit and scope of the invention. Identical or functionally equivalent elements are associated identical reference numerals. For reasons of clarity the elements may not be provided with reference numerals in all figures without losing their association, wherein.

DETAILED DESCRIPTION OF THE INVENTION

Figure 1:
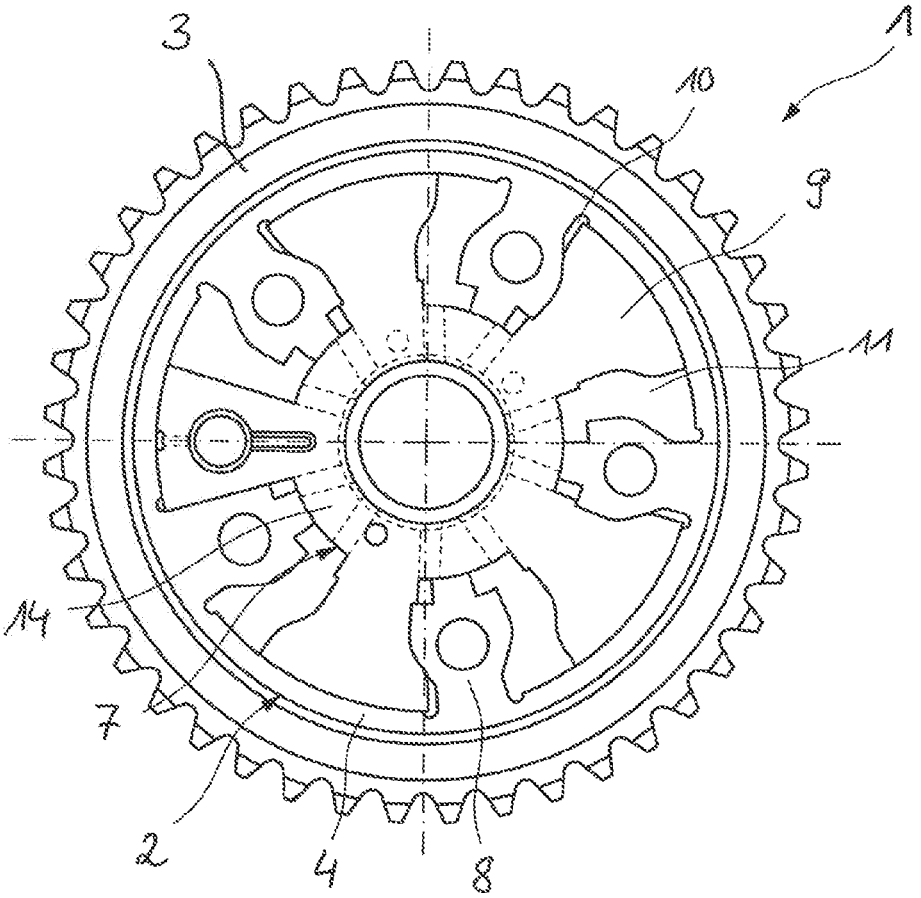
FIG. 1 illustrates a cross-section of the cam phaser.

FIG. 1 illustrates a cross-sectional view of a cam phaser 1, which facilitates an adjustment of opening and closing times of gas control valves of an internal combustion engine during operations of the internal combustion engine that is not illustrated in detail. Thus, a relative angular orientation of a camshaft of the internal combustion engine that is not illustrated in more detail is continuously variably adjusted relative to the crankshaft of the internal combustion engine that is not illustrated in more detail using the cam phaser 1, wherein the camshaft is rotated relative to the crankshaft. Rotating the camshaft adjusts opening and closing times of the gas control valves so that the internal combustion engine develops optimum power at a respective speed.

The cam phaser 1 includes a cylindrical stator 2 that is connected torque-proof with a drive gear 3 of the camshaft. The drive gear 3 is configured as a chain sprocket over which a chain that is not illustrated in more detail is run as a drive element. The stator 2 is operatively connected with the crankshaft through the drive element and the drive gear 3. Alternatively, the drive gear can be configured as a belt pulley, a tooth gear or a chain sprocket.

The stator 2 includes an essentially cylindrical stator base element 4, wherein radially inward extending bars 8 are configured at an inside of the stator base element 4 in uniform distances so that an intermediary space is formed between two adjacent bars 8. A pressure medium, typically hydraulic fluid, is introduced into the intermediary space in a controlled manner by a hydraulic valve that is not illustrated in more detail. They hydraulic valve can be arranged as a central valve in the cam phaser 1 or as a non-central valve outside of the cam phaser 1.

The stator base element 4 is connected with and sealed by one or two essentially disc shaped stator covers, wherein bolts 19 extend through receiving boreholes 17 of the bars 8 to connect the stator base element 4 with the at least one stator cover. The stator base element 4 can be configured integrally in one piece together with a stator cover. Furthermore, the drive wheel 3 can be configured integrally in one piece together with the stator base element 4 or the stator cover.

A vane 9 is arranged so that it protrudes into the intermediary space, wherein the vane is arranged at a rotor hub 14 of a rotor 7. The rotor hub 14 includes a number of vanes 9 that corresponds to a number of the intermediary spaces. Thus, the vanes 9 divide the intermediary spaces respectively into a first pressure cavity 10 and a second pressure cavity 11. In order to reduce a pressure loss in the first pressure cavity 10 and in the second pressure cavity 11 the bars 8 are configured so that they contact and seal with their faces at an outer enveloping surface of the rotor hub 14. The vanes 9 also contact and seal with their faces at an inner wall of the stator base element 4 that is arranged opposite to the outer enveloping surface.

The rotor 7 is connected torque proof with the camshaft 5 of the internal combustion engine which forms a camshaft arrangement 20 together with the cam phaser 1. In order to adjust an angular orientation between the camshaft 5 and the crankshaft the rotor 7 is rotated relative to the stator 2 about a rotation axis by an adjustment angle, wherein the stator 2 is arranged coaxial to the rotor 7. Thus, depending on a selected direction of rotation, the pressure medium in the first pressure chamber 10 or in the second pressure chamber 11 is pressurized while the second pressure chamber 11 or the first pressure chamber 10 is unloaded. The unloading is performed by a tank access which is open for unloading purposes.

The cam phaser 1 is exposed to extremely high alternating torques and transversal forces at the cam drive during operations. In order to improve the cam phaser 1 and the cam shaft arrangement 20 in particular for applications under very high alternating torques, devices to increase a friction of the friction locking connection between the rotor 7 and the camshaft 5 or a camshaft element and/or between the stator base element 4 and the stator cover are provided wherein the devices use micro-form locking. The rotor 7 or its rotor hub 14 or a component that cooperates with the rotor includes a first contact surface 12 at a face side in order to provide a form locking connection with a second contact surface 13 that is formed at the camshaft 5.

The stator base element 4 includes a third contact surface 16 at its face wherein the third contact surface 16 contacts an inner face of the stator cover that forms a fourth contact surface 21 to provide the friction locking connection.

According to the invention, hard particles 6 are provided to increase a friction value wherein the hard particles are connectable or connected with at least one of the contact surfaces 12, 13, 16, 21 without additional components or additional coatings on the contact surfaces. Thus, it is conceivable to apply the hard particles 6 to a single contact surface 12, 13, 16, 21 or to two cooperating contact surfaces.

The hard particles 6, which can be configured, e.g., as industrial diamonds, are applied by an atmospheric plasma deposition method so that they adhere to the contact surface 12, 13, 16, 21 or to the contact surfaces 12, 13, 16, 21 in that a coating 15 of the hard particles 6 connects with the respective contact surface through melting.

The coating 15 can be advantageously provided as an easily meltable nickel layer. The hard particles 6 can thus be adapted with respect to their sizes to a respective application and to the associated torques and transversal forces and to material pairings. The melting process facilitates a connection of the hard particles 6 with the respective contact surface 12, 13, 16, 21 that is secured against losing the hard particles 6.

Figure 2:
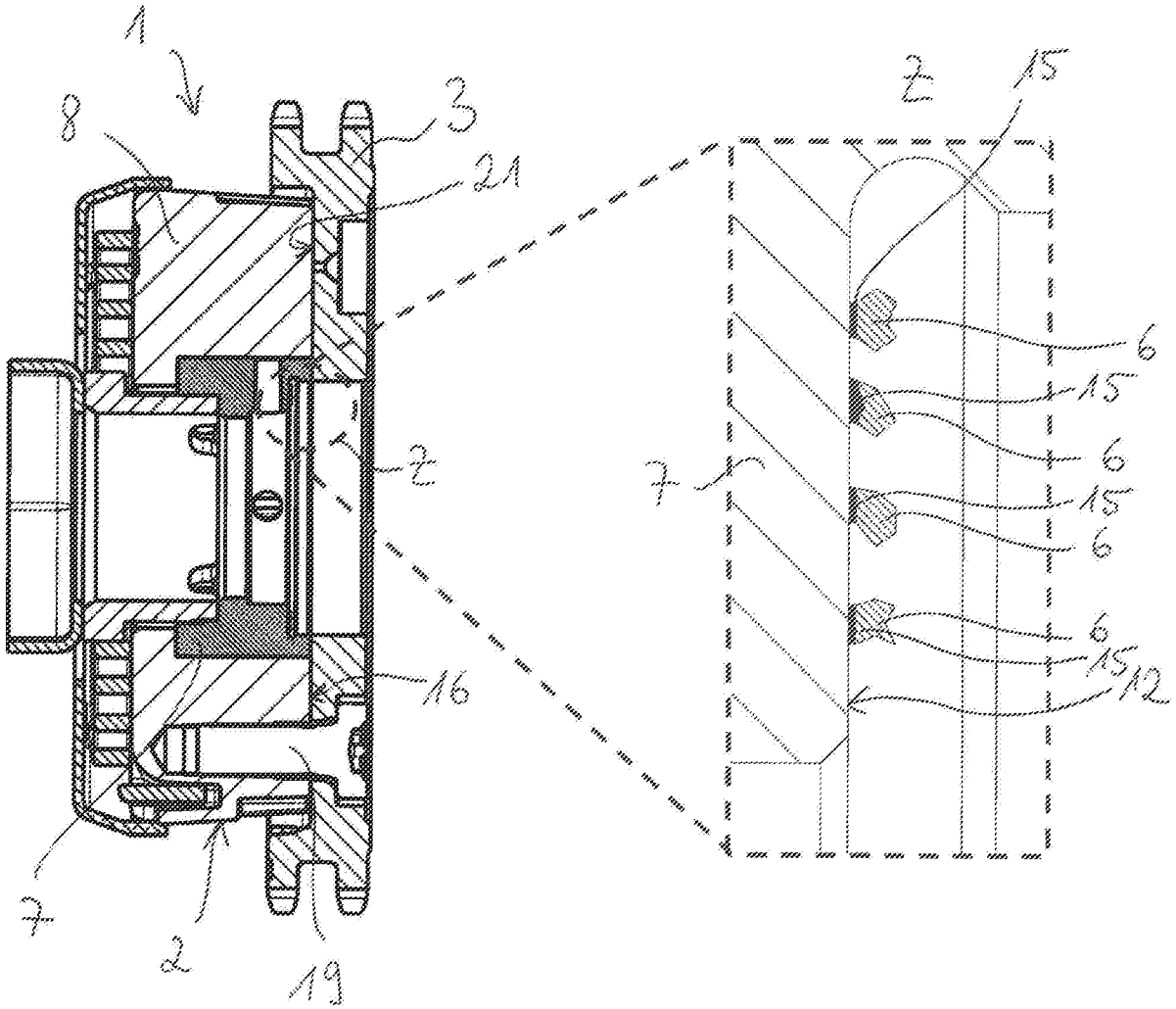
FIG. 2 illustrates a first embodiment of a cam phaser according to the invention in a longitudinal sectional view and with a blown-up detail of the first contact surface.

FIG. 2 illustrates a longitudinal sectional view of a first embodiment of a cam phaser 1, wherein the hard particles 6 are applied to the first contact surface 12 of the rotor 7. A blown up detail Z shows a detail of the rotor 7 and of its face which forms the first contact surface 12. The detail schematically illustrates the hard particles 6 that are connected with the rotor 7 by a melted on nickel coating 15, wherein the hard particles 6 are illustrated enlarged in the drawing figure. Depending on the requirements for friction increase, the hard particles 6 can thus be applied partially or entirely to the first contact surface 12.

The hard particles 6 can also be provided according to the invention on the second contact surface 13 of the camshaft 5 or on both contact surfaces 12, 13.

The hard particles 6 advantageously increase a static friction at the contact surfaces 12, 13 between the two connected friction partners rotor 7 and camshaft 5. Thus, higher torques or transversal forces can be transmitted under the same preload of the friction partners. By the same token, the preload of the friction partners can be reduced for the same transferable torques and an additional component for friction increase, and thus an associated assembly can be omitted.

Figure 3:
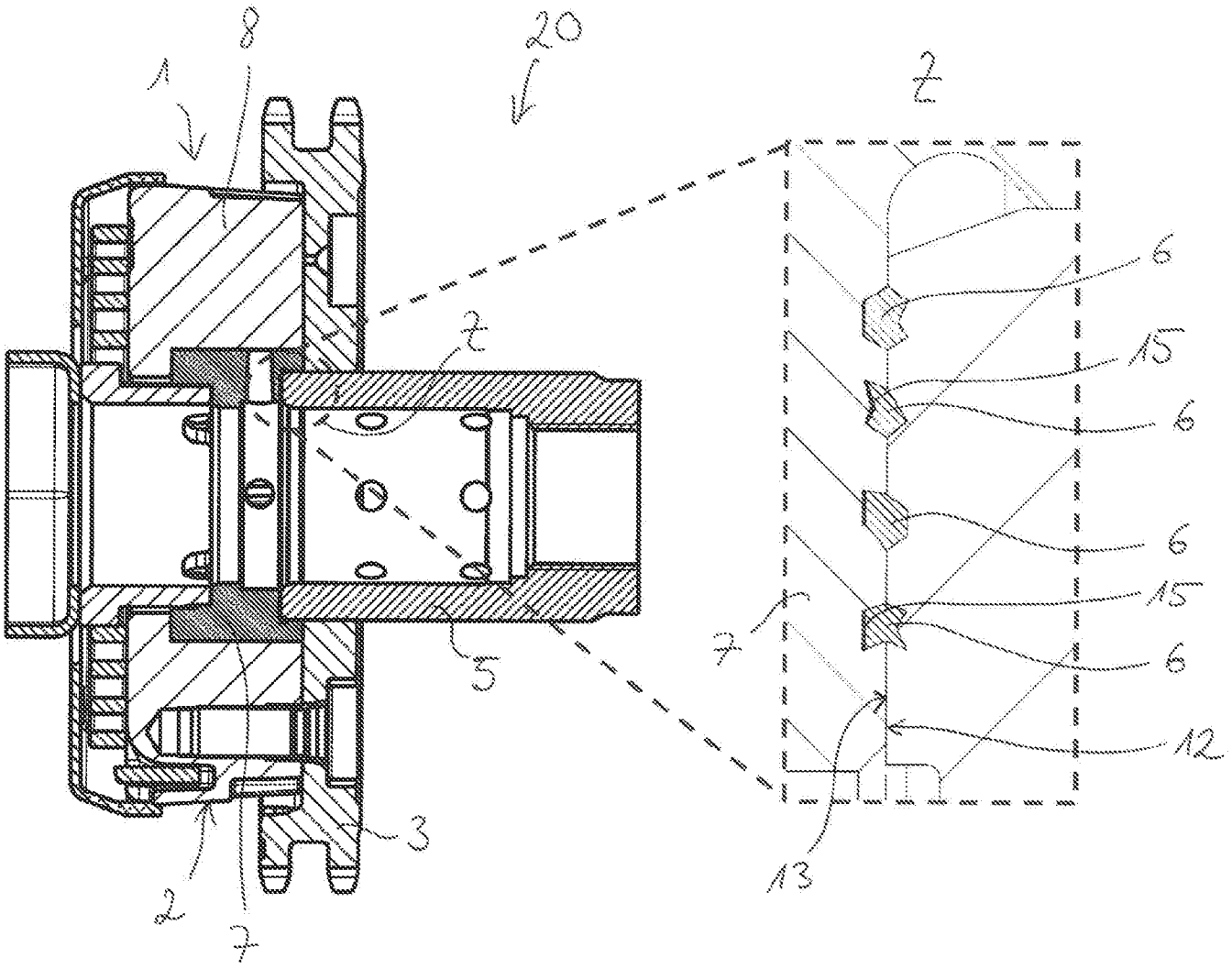
FIG. 3 illustrates a longitudinal sectional view of a camshaft arrangement with the cam phaser according to FIG. 2 with a blown-up detail of the connected contact surfaces.

FIG. 3 illustrates the camshaft arrangement 20 with the camshaft 5 and the cam phaser 1 that is connected through friction locking. The enlarged detail Z illustrates the now connected contact surfaces 12 and 13 of the rotor 7 and camshaft 5. It is evident that the hard particles 6 are embossed into both contact surfaces 12, 13. Thus, the embossing depth is a function of the material pairing of the rotor 7 and the camshaft 5. The materials of the rotor 7 and of the camshaft 5 can be configured differently and are softer than the hard particles. The rotor 7 and/or the stator 2 can be configured, e.g., from aluminum.

The contact surfaces 12, 13 are connected with each other without distance through friction locking by omitting additional components or coatings on the contact surfaces 12, 13, this means there is zero gap in the separation gap between the rotor 7 and the camshaft 5, which advantageously provides a reduction of the existing tolerance chain of the cooperating components.

The friction locking connection between the rotor 7 and the camshaft 5 can be provided in a simple manner by a non-illustrated central bolt of a central valve. Using a central valve yields a stroke reduction of an actuator that controls the central valve since tolerances with respect to the actuator stroke can be substantially reduced or eliminated entirely.

According to a non-illustrated alternative embodiment, the rotor 7 can include an adapter, at which the first contact surface 12 is configured. By the same token, the camshaft 5 can include a non-illustrated adapter. The adapter can be made respectively from a different material than the rotor 7 or the camshaft 5 or can be treated, e.g., by a heat treatment process.

Figure 4:
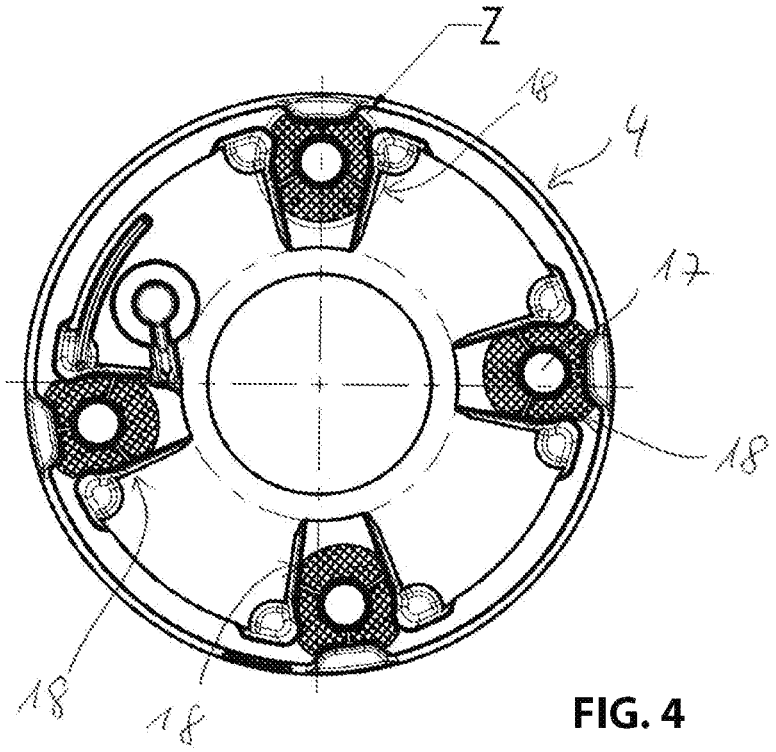
FIG. 4 illustrates a stator base element of second embodiment of a cam phaser according to the invention.
Figure 5:
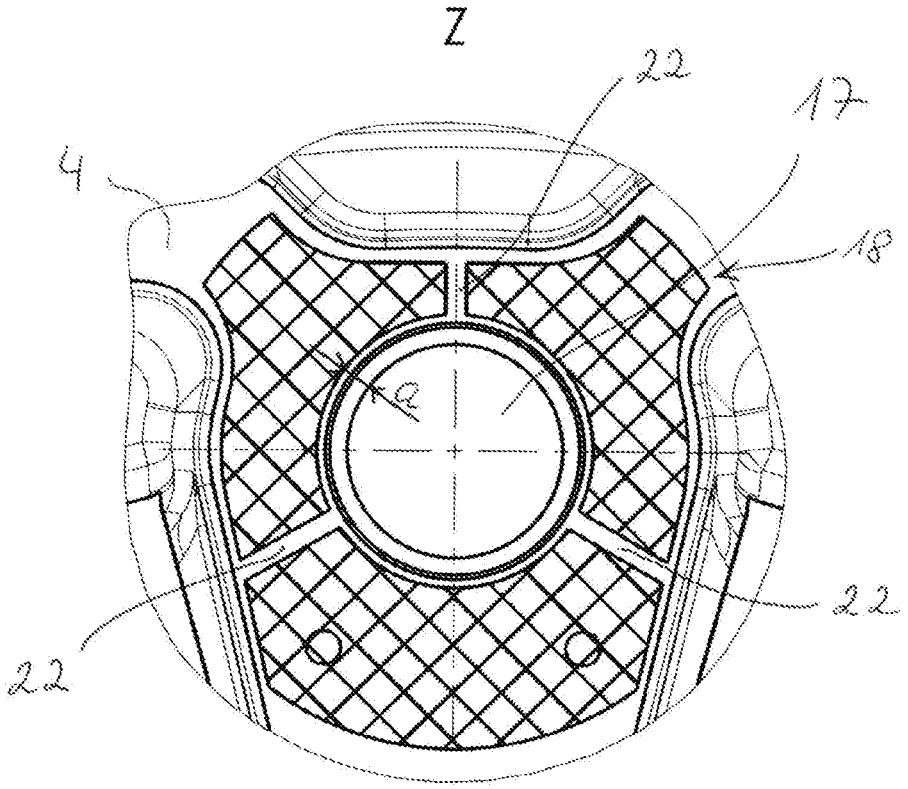
FIG. 5 illustrates an enlarged detail Z of the stator base element according to FIG. 4.

FIG. 4 illustrates a stator base element according to a second embodiment of a cam phaser 5 according to the invention in an enlarged detail Z.

In order to increase friction, the third contact surface 16 of the stator base element 4 includes hard particles 6 which are connectable or connected loss-proof with the third contact surface 16 without an additional support matrix.

The hard particles 6 advantageously increase static friction at the contact surfaces 16, 21 between the two connected friction partners stator base element 4 and stator cover. Thus, higher torques or transversal forces can be transmitted for an identical preload of the friction partners. By the same token, the preload of the friction partners can be reduced for identical transferable torques and an additional component for friction increase, and an associated assembly can be omitted.

As evident from FIG. 4, the third contact surface 16 of the stator base element 4 can be configured from plural contact portions 18, which are provided in a portion of receiving boreholes 17 that are configured in the bars 8. As described supra, the stator base element 4 is connected by bolts 19 with the stator cover or the stator covers. The bolts 19 are tightened with a predetermined preload force so that the covers and the stator base element form the recited friction partners wherein static friction is caused between the friction partners by the bolted connection.

The contact portions 18 are circular and respectively configured concentrically to a center of the respective receiving borehole 17, however, they can also be configured as a function of load about a respective receiving borehole. Put differently, a non-symmetrical configuration of the contact portions is conceivable.

In order not to influence the bolting function, it is possible to provide the contact portions 18 respectively at a predetermined distance a and the receiving borehole 17. This recess in the portion of the receiving boreholes 17 can be advantageously produced by a masking/cover of the threaded borehole. Using a masking generates plural bars 22 which interrupt the contact portions 18.

The invention also facilitates a combination of the embodiments. Thus, friction increasing hard particles can be combined with a friction disc between the friction partners. Thus, the hard particles can be applied to a friction disc that is arranged between the friction partners.

The advantages of the invention can be summed up as follows:

Friction increase: an identical preload force of the friction partners facilitates transferring higher torques and/or transversal forces. The preload force of the friction partners can be reduced for identical transferable torques (downsizing).

Loss safety: The hard particles are bonded to the at least one contact surface by melting the coating and thus become secured against loss. This facilitates a partial application to the contact surfaces.

Adaptation to the Application: The hard particles can be adapted with respect to their size to the respective application and thus to the occurring torques and transversal forces and to material pairings. Thus, the hard particles can be applied to one or plural contact surfaces depending on the application.

What is claimed is:

1. A cam phaser for a camshaft, the cam phaser comprising:

a stator that is operatively connected with a crankshaft through a drive wheel;

a rotor that is connectable torque proof with the camshaft and rotatable relative to the stator, wherein the drive wheel is connected torque proof or integrally configured in one piece with a stator base element or with a stator cover that is connected to and sealed relative to the stator base element, wherein a vane of the rotor is arrangeable between two bars of the stator and an intermediary space that is configured between the two bars is divided by the vane into a first pressure cavity and a second pressure cavity, wherein the rotor or a component that cooperates with the rotor includes a first contact surface configured to provide a friction locking connection with a second contact surface that is configured at the camshaft or at a camshaft component, wherein the stator base element includes a third contact surface configured to provide a friction locking connection with a fourth contact surface configured at the stator cover, wherein devices are provided that increase a friction of the friction locking connection by a micro form locking between the rotor and the camshaft or between the stator base element and the stator cover, and wherein hard particles are provided that increase the friction and that are connected with at least one contact surface from the group consisting of the first contact surface, the second contact surface, the third contact surface and the fourth contact surface without additional components or coatings of the at least one contact surfaces, wherein the hard particles include a jacket, and wherein the hard particles are bonded with the at least one contact surface loss proof by melted and re-solidified material from the jacket.

2. The cam phaser according to claim 1, wherein the hard particles are applied at least to a portion of the at least one contact surface.

3. The cam phaser according to claim 1, wherein the hard particles are configured as industrial diamonds with a nickel jacket and applied to the at least one contact surface by an atmospheric plasma coating method.

4. The cam phaser according to claim 1, wherein the first contact surface, the second contact surface, the third contact surface and the fourth contact surface are configured as faces.

5. The cam phaser according to claim 1, wherein the hard particles are applied to adhere to the first contact surface of the rotor or the second contact surface of the camshaft or the third contact surface of the stator base element or the fourth contact surface of the stator cover.

6. The cam phaser according to claim 1, wherein the rotor includes an adapter, and wherein the first contact surface is configured at the adapter.

7. The cam phaser according to claim 5, wherein the hard particles are applied to adhere at least to the third contact surface of the stator cover, and wherein the third contact surface is formed from plural contact portions which are provided in a portion of receiving boreholes that are configured in the bars.

8. The cam phaser according to claim 7, wherein the contact portions are configured circular and respectively concentric to the receiving boreholes.

9. The cam phaser according to claim 7, wherein the contact portions are configured as a function of transferrable load about the receiving boreholes.

10. The cam phaser according to claim 7, wherein the contact portions are respectively provided at a predetermined distance from the receiving boreholes.

11. The cam phaser according to claim 1, wherein a size of the hard particles is selected as a function of a respective application.

12. A camshaft arrangement, comprising:

the camshaft; and the cam phaser according to claim 1.

13. The camshaft arrangement according to claim 12, wherein the camshaft and the rotor are connected friction locked by a central bolt.

* * * * *